United States Patent [19]

Carver et al.

[11] 4,256,589

[45] * Mar. 17, 1981

[54] FIBER TREATING COMPOSITIONS COMPRISING (A) BLEND OF RANDOM COPOLY(OXYETHYLENE-OXYPROPYLENE)BUTANOLS (B) ALKALI METAL SULFUR COMPOUND AND (C) ALKALI METAL ORGANIC PHOSPHATE COMPOUND

[75] Inventors: Bobby C. Carver; Raymond E. Donaldson, both of Kingsport, Tenn.

[73] Assignee: Eastman Kodak Company, Rochester, N.Y.

[ * ] Notice: The portion of the term of this patent subsequent to Sep. 25, 1996, has been disclaimed.

[21] Appl. No.: 24,235

[22] Filed: Mar. 26, 1979

Related U.S. Application Data

[63] Continuation-in-part of Ser. No. 878,342, Feb. 16, 1978, Pat. No. 4,169,061, which is a continuation of Ser. No. 679,257, Apr. 22, 1976, abandoned.

[51] Int. Cl.[3] ..... D06M 13/10; D06M 13/18; D06M 13/26; D06M 13/32

[52] U.S. Cl. ..... 252/8.7; 8/115.6; 252/8.9

[58] Field of Search ..... 8/115.6; 252/8.7, 8.9

[56] References Cited

U.S. PATENT DOCUMENTS

| | | | |
|---|---|---|---|
| 2,425,755 | 8/1947 | Roberts et al. | 252/8.9 |
| 3,907,689 | 9/1975 | Carver | 252/8.7 |
| 3,951,825 | 4/1976 | Carver | 252/8.7 |
| 4,051,299 | 9/1977 | Steinmiller | 252/8.7 |
| 4,129,507 | 12/1978 | Marshall et al. | 8/115.6 |
| 4,169,061 | 9/1979 | Carver et al. | 252/8.9 |
| 4,169,062 | 9/1979 | Weipert | 252/8.9 |

*Primary Examiner*—Joseph L. Schofer
*Assistant Examiner*—Herbert J. Lilling
*Attorney, Agent, or Firm*—Clyde L. Tootle; Daniel B. Reece, III

[57] ABSTRACT

This invention relates to a fiber treating composition which can be applied to partially oriented polyester fiber. The fiber treating composition contains as the lubricant a blend of at least two random copoly(oxyethylene-oxypropylene) butanols and from greater than 12 to about 30 percent by weight of an ethoxylated fatty and/or lower alkyl aryl alcohol alkali metal phosphate and about 1 to 8 percent of an alkali metal lower alkyl aryl sulfonate, or an alkali metal lower alkyl sulfosuccinate or combinations of such alkali metal compounds with other conventional antistat agents or processing aids. Fibers having the textile treating composition deposited thereon can be texturized satisfactorily at very high rates of speed by the friction twist method.

16 Claims, No Drawings

FIBER TREATING COMPOSITIONS COMPRISING (A) BLEND OF RANDOM COPOLY(OXYETHYLENE-OXYPROPYLENE)-BUTANOLS (B) ALKALI METAL SULFUR COMPOUND AND (C) ALKALI METAL ORGANIC PHOSPHATE COMPOUND

This is a continuation-in-part of application Ser. No. 878,342 filed Feb. 16, 1978, now U.S. Pat. No. 4,169,061 which is a continuation of application Ser. No. 679,257, filed Apr. 22, 1976 now abandoned.

This invention relates to the lubrication and conditioning of textile yarns and filaments. More particularly, this invention relates to fiber treating compositions particularly useful on polyester textile yarn in draw texturizing operations.

As is well known in the manufacture of most types of yarns, it is necessary to place a fiber treating composition onto the yarn in order to reduce the tendency of the yarn toward breakage of the individual filaments or fibers when they are subjected to various mechanical processing treatments such as spinning, twisting, winding and other various operations. One such operation in the processing of partially oriented polyester filament yarns is texturizing. In texturizing, the process involves false twisting and heat-setting the twist and untwisting a yarn fed continuously through the process. Partially oriented polyester filament yarns are currently being texturized commercially by either the false twist pin method or the newer, more demanding friction twist method. Both of these methods employ passing the yarn over a heater plate. Conventional texturizing yarns suitable for processing by the pin twist method are not suitable for processing on friction twist equipment due to increased defect levels (broken filaments and loops) in the texturized yarn and increased polymer abrasion at the friction discs which is due partially to increased speed and volume through put. It would therefore be an advance in the state of the art to provide a textile lubricant which can be applied to polyester yarns which can be processed at high throughput rates on friction twist equipment without excessive defects and abrasion by the friction disc.

It is therefore an object of the present invention to provide a textile treating composition suitable for high speed processing of synthetic yarns.

Another object of this invention is a yarn lubricated with the novel lubricant which can be used in the production of highly uniform, textured yarn.

A still further object of the invention is to provide a composition for the lubrication of polyester yarns at elevated temperatures without adversely affecting the properties of the yarn.

Further objects and advantages of the invention will be apparent to those skilled in the art from the accompanying disclosure and claims.

In accordance with the present invention, a textile treating composition is provided for use on textile fibers formed from thermoplastic material, such as polyesters. The textile treating composition contains as one lubricant a blend of a major amount of a random copoly(oxyethylene-oxypropylene) butanol containing 50 mole percent ethylene oxide having a viscosity lower than 300 seconds at 100° F. in Saybolt Universal Seconds (SUS), and a minor amount of a random copoly(oxyethylene-oxypropylene) butanol containing 50 mole percent ethylene oxide having a viscosity of not less than 2,000 seconds at 100° F. in Saybolt Universal Seconds (SUS). In addition to the lubricant, the textile treating composition also contains about 1 to about 8 weight percent, based on total lubricant, of an alkali metal lower alkyl aryl sulfonate or an alkali metal lower alkyl sulfosuccinate, and more than about 12 to about 30 weight percent, based on total lubricant, of an ethoxylated fatty and/or lower alkyl aryl alcohol alkali metal phosphate or combinations of these additives with other conventional antistat agents or processing aids. The textile treating composition can be applied directly to the synthetic fiber, or a carrier or diluent, such as water, can be used and the textile treating composition applied to the fiber as an emulsion.

The lubricant provided by the increased amount of ethoxylated fatty and/or lower alkyl aryl alcohol alkali metal phosphate provides an improvement in processing yarns at higher processing speeds from that obtained with the lubricants of Applicants' U.S. Patent Application Ser. No. 878,342 filed Feb. 16, 1978. While applicants' parent U.S. Patent Application Ser. No. 878,342 filed Feb. 16, 1978, provides lubricants which have exceptional processing characteristics at processing speeds up to and including about 350 meters/minute, if the processing rate is increased to 600 meters/minute, or greater, some broken filaments or loops (defects) are noted in the textured yarn. By increasing the ethoxylated fatty and/or lower alkyl aryl alcohol alkali metal phosphate from an amount greater than 12 percent to about 30 percent by weight, the lubricant enables yarn texturizing speeds of 700 meters/minute or greater to be used and yarns texturized at these high speeds shows a significant decrease in broken filaments and defects.

The textile treating compositions of the present invention are particularly useful in the manufacture of partially oriented polyester fibers. Partially oriented polyester fibers containing the textile treating compositions at low lubricant levels can be wound on packages at high speeds and maintain good package build relatively free from winding defects. The partially oriented polyester fiber can subsequently be draw-textured to produce yarn which is relatively free from short-term dye variations. Moreover, in processing the fiber containing the textile treating composition by draw-texturizing, less force is required to draft the fiber. Also, the accumulation of deposits on the heater plates and draw-texturizing equipment is of an acceptable level. The textile treating composition also reduces the level of smoke and does not form insoluble deposits on the heater plates at the temperatures necessary for friction-texturizing.

The textile treating composition which provides the lubricity to the yarn comprises a blend of at least two different random copoly(oxyethylene-oxypropylene) butanols containing 50 mole percent ethylene oxide. One such blend contains about 98 to 51, preferably 95 to 60, more preferably 90 to 30, percent, by weight, of textile treating composition of a random copoly(oxyethylene-oxypropylene) butanol having a preferred viscosity of 100 at 100° F. in Saybolt Universal Seconds (SUS), and about 2 to 49, preferably 5 to 40, most preferably 10 to 30, percent, by weight, of textile treating composition of a random copoly(oxyethylene-oxypropylene) butanol having a preferred viscosity of 5100 at 100° F. in Saybolt Universal Seconds (SUS). One method for preparing the poly(oxyethylene-oxypropylene) butanols of the present invention is shown in U.S. Pat. No. 2,425,755. Of the polyoxyalkylenes useful for this invention, the weight ratio of ethylene oxide groups, i.e., the groups —$CH_2$—$CH_2O$—, to propylene oxide groups, i.e., the groups $$\left(CH_2-\underset{\underset{CH_3}{|}}{CH}-O\right)$$

is preferably between about 3:1 and 1:3, most preferably 1:1 in order that the material remain fluid and water-soluble. It is important that the viscosity of the polyoxyalkylene diol blend be between 300 and 5,000 SUS at 100° F. If the viscosity is too low, broken filaments of the yarn carrying the finish result; whereas, if the viscosity is too high, unwanted twist-slippage in the draw-texturing process occurs.

The alkali metal salts of a phosphoric acid mono- or diester of an ethylene oxide adduct useful in the present invention are those of at least one member selected from the group consisting of a $C_8$ to $C_{18}$ linear lower alkyl alcohol or a similar lower alkyl aryl alcohol. Such lower alkyl aryl alcohols include, for example, the $C_1$ to $C_{18}$ lower alkyl substituted phenols. Such alkali metals and salts thereof include the lithium, potassium and sodium salts. Such components include the alkali metal salts of a phosphoric acid mono- or diester of an ethylene oxide adduct of at least one member selected from the group consisting of a $C_8$ to $C_{18}$ linear alkyl alcohol are, for example: POE (3) octyl potassium phosphate, POE (2) decyl potassium phosphate, POE (4) lauryl potassium phosphate, POE (5) octyl potassium phosphate, POE (5) decyl potassium phosphate, POE (5) lauryl potassium phosphate, POE (5) myristyl potassium phosphate, POE (5) cetyl sodium phosphate, POE (5) stearyl potassium phosphate, POE (10) octyl potassium phosphate, POE (12) decyl potassium phosphate, POE (16) lauryl potassium phosphate, POE (18) stearyl potassium phosphate, POE (20) octyl potassium phosphate, POE (25) cetyl potassium phosphate, POE (8) dinonyl phenol potassium phosphate and the like.

The alkali metal salts of lower alkylaryl sulfonate useful in the present invention are, for example: sodium octyl benzene sulfonate, sodium decyl benzene sulfonate, sodium dodecyl benzene sulfonate, and the like. The alkali metal lower alkyl sulfosuccinates useful in the present invention are, for example, sodium dioctyl sulfosuccinate, potassium dioctyl sulfosuccinate, sodium dihexyl sulfosuccinate, sodium didodecyl sulfosuccinate, and the like. It should also be noted that the terms "alkali metal" and "alkali metal salts" include as the alkali metal a member of the group consisting of lithium, sodium and potassium. Also, the term "lower alkyl" used in the present specification includes, for example, the $C_1$ to $C_{18}$ alkyl groups.

The lubricant can be prepared by blending the components in a container with moderate agitation. Aqueous emulsions can be prepared from the blended oil. The blended oil is poured with agitation into room temperature (ambient) water which contains sufficient potassium hydroxide (KOH) to neutralize the resulting oil mixture to a pH of about 7 to provide a clear solution of the desired oil in water concentration. Alternatively, the aqueous emulsion can be prepared by adding each component to the water with agitation to provide a water clear solution. Preferably the potassium hydroxide is added first to the water before the addition of the remaining components.

The textile treating composition can be applied neat to the fiber or can be applied with a carrier, such as water, in solution. Aqueous solution can be prepared at any ratio of oil to water. Emulsions containing from 1 to 50 weight percent of the textile treating composition are preferred with those containing about 5 to 25 weight percent being most preferred. The method of application can affect the amount added to the yarn. Rolls use dilute solutions whereas metering pumps can use more highly concentrated solutions.

The textile treating composition is normally applied to the yarn soon after the yarn exits from the spinning cabinet and prior to its being wound on a package. The textile treating composition can also be applied by immersion or as a spray, or by any other means during winding. A preferred method is to apply the composition by passing the yarn over a pair of rotating finish rolls. The finish rolls are normally located ahead of the godet rolls, but they could be located between or after the godet rolls. The yarn contact with the finish rolls is controlled by guides which are located before and after each roll. Very light contact with the finish roll is preferred. While finish rolls commonly used in the trade are generally made of aluminum oxide type materials, other materials such as metal rolls and flame coated rolls could be used. Two finish rolls are preferred in most cases; however, finishes have been successfully applied with one roll. More than two rolls could be used but they would be expensive and they are thought to be unnecessary. Methods other than rotating rolls can be used to apply the finish to the yarn. Yarn finishes can be applied by immersion, wicking devices, and sprays or other atomizing type devices.

When using rotating finish rolls to apply finish to a yarn from an emulsion, the amount of finish applied will depend on the yarn speed, contact angle with the roll, finish roll speed, yarn size, and filament count and the percent of oil in the emulsion. The preferred level of oil in the emulsion is between 5% and 25%. It is felt that a straight oil would work if a satisfactory method of applying it could be devised. Solutions of oil in organic solvents could be used as long as the solvent had no adverse effect on the yarns.

The preferred finish level is from 0.2% to 2% by weight; however, yarns having 0.1% to 2.5% have been used. Higher levels could be used but it would cost more and it is expected that the deposit build-up on the draw texturing equipment would be greater than at the preferred level.

The textile treating compositions of the present invention provide yarn frictional properties which are suitable for both winding and draw-texturing. Yarns with these finishes have performed well in draw-texturing, as evidenced by threadline tensions, low deposit buildup on equipment and by the acceptable properties and uniform dyeing of the textured yarns.

This invention will be further illustrated by the following examples although it will be undertood that these examples are included merely for purposes of illustration and are not intended to limit the scope of the invention.

EXAMPLE 1

The following components are blended to form a solution. The lubricant components and their weight percentage composition are:

| | |
|---|---|
| Random copoly(oxyethylene-oxypropylene) butanol | 75% |

-continued

| | |
|---|---|
| containing 50 mole percent ethylene oxide having a viscosity of 100 at 100° F. (SUS) (Ucon 50 HB-100) | |
| Random copoly(oxyethylene-oxypropylene) butanol containing 50 mole percent ethylene oxide having a viscosity of 5100 at 100° F. (SUS) (Ucon 50 HB-5100) | 20% |
| POE (8) dinonyl phenol phosphoric acid-potassium salt | 3% |
| Sodium dodecyl benzene sulfonate | 2% |
| | 100% |

EXAMPLE 2

The following components were blended to form a solution. The lubricant components and their weight percentage composition are:

| | |
|---|---|
| Random copoly(oxyethylene-oxypropylene) butanol containing 50 mole percent ethylene oxide having a viscosity of 100 at 100° F. (SUS) (Ucon 50 HB-100) | 61.6% |
| Random copoly(oxyethylene-oxypropylene) butanol containing 50 mole percent ethylene oxide having a viscosity of 5100 at 100° F. (SUS) (Ucon 50 HB-5100) | 15.4% |
| POE (8) dinonylphenol phosphoric acid-potassium salt | 20% |
| Sodium dodecyl benzene sulfonate | 3% |
| | 100% |

The above two fiber lubricants were evaluated on 150 denier partially oriented polyester filament yarn at processings of 350 meters/minute and 600 meters/minute. The following results were obtained:

| | 350 Meters/Minute | |
|---|---|---|
| | Ex. 1 | Ex. 2 |
| BF/lb.[1] | .2 to .5 | .2 to .5 |
| Loops/lb.[2] | 0 | 0 |
| Total defects/lb. | .2 to .5 | .2 to .5 |
| | 600 Meters/Minute | |
| | Ex. 1 | Ex. 2 |
| BF/lb.[1] | 2.50 | .13 |
| Loops/lb.[2] | 1.80 | .43 |
| Total defects/lb. | 4.30 | .56 |
| | 700 Meters/Minute | |
| | | Ex. 2 |
| BF/lb.[1] | | 0.37 |
| Loops/lb.[2] | | 0.60 |
| Total defects/lb. | | 0.97 |

[1]Broken filaments per lb. of texturized yarn by endwall count method.
[2]Loops per lb. of texturized yarn.

This shows that the added improvement obtained with the addition of the more than 12 percent by weight of an ethoxylated fatty and/or lower alkyl aryl alcohol alkali metal phosphate provides a satisfactory lubricant which can be used at greatly increased texturizing speeds. Note, for example, that even at speeds of up to 700 meters/minute applicants' improved lubricant provides results comparable to that provided by applicants' parent application at speeds of 350 meters/minute.

The textile treating compositions of the present invention provide the art with lubricants which can be used to prepare fully drawn or partially oriented thermoplastic yarns, such as nylon and polyester. The partially oriented yarn can be draw-texturized, either simultaneously or sequentially, to provide full drawn yarn having consistent dye uniformity. The lubricants can be processed satisfactorily on conventional textile equipment without excessive build-up of deposits on heated surfaces and spindles. These improved textile compositions also have low volatility and do not provide an excessive amount of smoking. Also, yarn having these textile treating compositions can be draw-textured with less force required to draw the yarn.

Although the invention has been described in considerable detail with particular reference to certain preferred embodiments thereof, variations and modifications can be effected within the spirit and scope of the invention.

We claim:

1. A textile treating composition comprising as the lubricant a blend of a major amount of a random copoly(oxyethyleneoxypropylene) butanol having a viscosity of lower than 300 seconds at 100° F. in Saybolt Universal Seconds (SUS), and a minor amount of a random copoly(oxyethylene-oxypropylene) butanol having a viscosity of not less than 2000 seconds at 100° F. in Saybolt Universal Seconds (SUS), said polyoxyalkylene blend having a vicosity between 300 and 5,000 SUS at 100° F., and a processing aid (A) from about 1 to 8 percent by weight of an alkali metal lower alkyl aryl sulfonate or an alkali metal lower alkyl sulfosuccinate and (B) from more than 12 to about 30 percent by weight of an ethoxylated fatty and/or lower alkyl aryl alcohol alkali metal phosphate.

2. A textile composition according to claim 1 wherein said alkali metal aryl sulfonate is present in an amount of about 1 to about 6 percent by weight.

3. A textile treating composition according to claim 2 wherein said ethoxylated fatty and/or lower alkyl aryl alcohol alkali metal phosphate is present in an amount of about 15 to about 25 percent by weight.

4. A textile treating composition according to claim 3 wherein said alkali metal aryl sulfonate is sodium dodecyl benzene sulfonate.

5. A textile treating composition according to claim 4 wherein said ethoxylated fatty and/or lower alkyl aryl alcohol alkali metal phosphate is POE (8) dinonyl phenol potassium phosphate.

6. A textile treating composition comprising as the lubricant a blend of 95 to 60 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 3:1 to 1:3, and 5 to 40 percent by weight of a random copoly(oxyethylene-oxypropylene) butanol having a viscosity of not less than 2000 seconds at 100° F. in Saybolt Universal Seconds (SUS) containing a weight ratio of ethylene oxide groups to propylene oxide groups of 3:1 to 1:3, said polyoxyalkylene blend having a viscosity between 500 and 5,000 SUS at 100° F. and as a processing aid (A) from about 1 to 8 percent by weight of an alkali metal alkyl benzene sulfonate or an alkali metal lower alkyl sulfosuccinate and (B) more than about 12 to about 30 percent by weight of an ethoxylated fatty and/or lower alkyl aryl alcohol alkali metal phosphate.

7. A textile composition according to claim 6 wherein said alkali metal aryl sulfonate is present in an amount of about 2 to about 6 percent by weight.

8. A textile treating composition according to claim 7 wherein said ethoxylated fatty and/or lower alkyl aryl alcohol alkali metal phosphate is present in an amount of about 15 to about 25 percent by weight.

9. A textile treating composition according to claim 8 wherein said alkali metal aryl sulfonate is sodium dodecyl benzene sulfonate.

10. A textile treating composition according to claim 9 wherein said ethoxylated fatty alcohol alkali metal phosphate is POE(8) dinonyl phenol potassium phosphate.

11. A textile treating composition comprising as the lubricant a blend of 90 to 70 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, and 10 to 30 percent by weight of a random copoly(oxyethylene-oxypropylene) butanol having a viscosity of not less than 2000 seconds at 100° F. in Saybolt Universal Seconds (SUS) containing a weight ratio of ethylene oxide groups to propylene oxide groups of 1:1, said polyoxyalkylene blend having a viscosity between 500 and 5,000 SUS at 100° F. and as a processing aid (A) from about 1 to 8 percent by weight of an alkali metal alkyl aryl sulfonate or an alkali metal lower alkyl sulfosuccinate and (B) more than about 12 to about 30 percent by weight of an ethoxylated fatty alcohol and/or lower alkyl aryl alkali metal phosphate.

12. A textile composition according to claim 11 wherein said alkali metal aryl sulfonate is present in an amount of about 2 to about 6 percent by weight.

13. A textile treating composition according to claim 12 wherein said ethoxylated fatty and/or lower alkyl aryl alcohol alkali metal phosphate is present in an amount of about 15 to about 25 percent by weight.

14. A textile treating composition according to claim 13 wherein said alkali metal aryl sulfonate is sodium dodecyl benzene sulfonate.

15. A textile treating composition according to claim 14 wherein said ethoxylated fatty and/or lower alkyl aryl alcohol alkali metal phosphate is POE(8) dinonyl phenol potassium phosphate.

16. A textile treating composition comprising a blend of 60 to 65 percent by weight of a random copoly(oxyethyleneoxypropylene) butanol having a viscosity of lower than 300 seconds at 100° F. in Saybolt Universal Seconds (SUS) containing a weight ratio of ethylene oxide groups to propylene oxide groups of 1:1, and 10 to 20 percent by weight of a random copoly(oxyethyleneoxypropylene) butanol having a viscosity of not less than 2000 seconds at 100° F. in Saybolt Universal Seconds (SUS) containing a weight ratio of ethylene oxide groups to propylene oxide groups of 1:1, said polyoxyalkylene blend having a viscosity between 500 and 5,000 SUS at 100° F., about 15 to 25 percent by weight of POE(8) dinonyl phenol phosphoric acid—potassium salt and 2 to 5 percent by weight of sodium dodecyl benzene sulfonate.

* * * * *